US010182957B2

(12) United States Patent
Chetlapalli et al.

(10) Patent No.: US 10,182,957 B2
(45) Date of Patent: Jan. 22, 2019

(54) CONTINUOUS PASSIVE MOTION DEVICE

(71) Applicant: OSSUR HF, Reykjavik (IS)

(72) Inventors: Janaki Ram-srinivasaRao Chetlapalli, Irvine, CA (US); Harry Duane Romo, Aliso Viejo, CA (US)

(73) Assignee: OSSUR HF, Reykjavik (IS)

( * ) Notice: Subject to any disclaimer, the term of this patent is extended or adjusted under 35 U.S.C. 154(b) by 471 days.

(21) Appl. No.: 14/743,246

(22) Filed: Jun. 18, 2015

(65) Prior Publication Data

US 2015/0366736 A1 Dec. 24, 2015

Related U.S. Application Data

(60) Provisional application No. 62/013,685, filed on Jun. 18, 2014.

(51) Int. Cl.
*A61H 1/02* (2006.01)

(52) U.S. Cl.
CPC ..... *A61H 1/0214* (2013.01); *A61H 1/024* (2013.01); *A61H 1/0237* (2013.01); *A61H 1/0244* (2013.01); *A61H 2201/1215* (2013.01); *A61H 2201/1642* (2013.01); *A61H 2201/1664* (2013.01); *A61H 2201/1671* (2013.01); *A61H 2201/5058* (2013.01); *A61H 2201/5097* (2013.01)

(58) Field of Classification Search
CPC .... A61H 1/0214; A61H 1/0237; A61H 1/024; A61H 1/0244; A61H 1/0255; A61H 1/0259; A61H 1/0266; A61H 2001/0248; A61H 2201/1215; A61H 2201/164; A61H 2201/1642; A61H 2201/1664; A61H 2201/1671; A61H 2201/5097; A61H 2201/5508; A63B 21/02; A63B 21/22; A63B 21/0555; A63B 23/04
See application file for complete search history.

(56) References Cited

U.S. PATENT DOCUMENTS 4,665,899 A * 5/1987 Farris ..... A61H 1/0259 601/33
4,825,852 A * 5/1989 Genovese ..... A61H 1/0259 482/901
4,930,497 A * 6/1990 Saringer ..... A61H 1/0259 601/34
4,974,830 A * 12/1990 Genovese ..... A61H 1/0259 601/24
5,170,776 A * 12/1992 Pecheux ..... A61H 1/0266 601/104
5,399,147 A 3/1995 Kaiser
(Continued)

*Primary Examiner* — Andrew S Lo
(74) *Attorney, Agent, or Firm* — Workman Nydegger

(57) ABSTRACT

A CPM device includes a support structure arranged to be removably attached to an articulating brace supporting a limb and a joint of a user. One or more rotating members are rotatably connected to the support structure. The rotating members are adapted to contact and roll on an underlying surface that is separate from the CPM device. At least one motor is arranged to apply a torque to the rotating members such that the rotating members roll on the underlying surface. The rolling of the rotating members on the underlying surface causes the support structure to translate over the underlying surface, which, in turn, conveys a bending force to the joint.

18 Claims, 3 Drawing Sheets

(56) References Cited

U.S. PATENT DOCUMENTS

| | | | | |
|---|---|---|---|---|
| 6,416,448 | B1 * | 7/2002 | Hassler | A61H 1/024 482/113 |
| 6,872,186 | B2 * | 3/2005 | Branch | A61H 1/0259 482/130 |
| 6,872,187 | B1 * | 3/2005 | Stark | A61F 5/0102 482/8 |
| 7,037,287 | B2 | 5/2006 | Cormier et al. | |
| 8,142,379 | B2 | 3/2012 | Verdonk et al. | |
| 8,172,781 | B2 | 5/2012 | Oddou et al. | |
| 8,409,117 | B2 | 4/2013 | Cheng et al. | |
| 8,425,579 | B1 * | 4/2013 | Edelman | A61F 7/02 601/34 |
| 8,517,964 | B2 | 8/2013 | Sreeramagiri et al. | |
| 8,696,606 | B2 * | 4/2014 | Jacofsky | A61H 1/0237 601/122 |
| 2005/0101887 | A1 | 5/2005 | Stark et al. | |
| 2005/0273022 | A1 * | 12/2005 | Diaz | A61H 1/024 601/5 |
| 2006/0004251 | A1 | 1/2006 | Bookwalter et al. | |
| 2006/0069336 | A1 | 3/2006 | Krebs et al. | |
| 2010/0204620 | A1 * | 8/2010 | Smith | A61H 1/024 601/34 |
| 2012/0095377 | A1 | 4/2012 | Smith et al. | |
| 2012/0232439 | A1 * | 9/2012 | Garcia | A61H 1/024 601/5 |
| 2013/0233323 | A1 | 9/2013 | Koller-Hodac et al. | |
| 2013/0261511 | A1 | 10/2013 | Smith et al. | |
| 2014/0148736 | A1 * | 5/2014 | Hoffman | A61H 1/024 601/5 |

* cited by examiner

CONTINUOUS PASSIVE MOTION DEVICE

TECHNICAL FIELD

This disclosure relates to a device for providing continuous passive motion therapy.

BACKGROUND

Continuous passive motion ("CPM") therapy is used in recovery following joint trauma and has been found to have beneficial results in the rehabilitation of injured joints and/or limbs. Continuous passive motion can also be used for treatment of other bone and muscular disorders, such as arthritis. For patients recovering from extensive joint surgery any attempt at joint motion causes extreme pain. Consequently, patients tend to avoid substantial movement of the limb. This immobilization allows the tissue around the joint to become stiff and scar tissue to form. These undesirable effects lead to limited range of motion in the joint and prolong physical therapy before the joint and limb regain substantial range of motion, neurological function and muscle function. If full range of motion of the joint and limb is not achieved in the immediate or early postoperative period, then the full range of motion may never be recovered.

CPM devices are often used during early phases of postoperative rehabilitation to provide passive motion to the treated joint and limb, to control postoperative pain, and reduce inflammation. Typical CPM devices move a patient's limb and joint through a predetermined range of motion without exertion by the patient. The passive motion acts to pump blood and interstitial fluid away from the joint and surrounding tissue. It also acts to increase absorption of synovial fluid by the cartilage, which provides nutrients. As a result, CPM devices can reduce joint stiffness and improve venous blood flow.

Several CPM devices are available for use in therapy for the rehabilitation of the knee. Conventional devices commonly include a stationary base or frame, a femur support which supports the upper part of the leg, a tibia support which supports the lower part of the leg, a foot support for supporting the foot, and a drive system. The femur and tibia supports are pivoted with respect to each other, and are supported above the stationary base.

These devices however suffer from several disadvantages. Among these is the fact that conventional devices are large, cumbersome, complicated, and heavy. For example, they can be very difficult for a patient in a hospital bed or a medical professional to move out of the way when it is necessary to change the sheets or bed linens. They are also not designed for easy transportability, some weighing in excess of 34 kg (75 pounds) and/or too large and awkward to transport in a standard vehicle. Further, conventional devices also have been generally too expensive for individuals to purchase for home use.

Another disadvantage is that traditionally a knee brace or other type of brace is worn separately from the CPM device, and is removed prior to CPM therapy. For instance, when it is time to exercise the limb or joint, the patient typically removes their brace or cast and places the injured limb or joint on soft goods of the CPM. The patient and/or medical professional must then ensure that the mechanics of the brace and the CPM device are not in conflict such that they do not cause damage to the patient's limb or joint. This process can be time-consuming, uncomfortable, and even dangerous to the patient if not done properly.

Removal of the knee brace prior to CPM therapy may also be physically difficult and painful. The effectiveness of a therapy is dependent on the ease in which the therapy may be applied. If it is difficult for a therapy recipient to self-apply a therapy, the opportunity to receive therapy may be diminished. Furthermore, if therapies are complicated and/or uncomfortable, a therapy recipient is less likely to undergo the therapy, although it may be beneficial.

There is a need for a CPM device that is transportable, lightweight, affordable, and versatile. There also exists a need for a CPM device that allows a brace to be quickly connected and disconnected to the CPM device to avoid requiring the user to remove the brace during CPM therapy.

SUMMARY

According to various embodiments of the disclosure, a CPM device is provided for imparting CPM therapy without the physical and operational restrictions of a stationary base, or the accompanying bulk and complicated features. Without a stationary base, the weight and size of the CPM device is significantly reduced and the CPM device can be easily transported and operated in wide variety of settings. Thus, a user, a physician, and/or physical therapist can take the CPM device almost anywhere.

The embodiments also can address the problem of patients having to remove a post-surgical brace or other type of brace prior to CPM therapy. The embodiments have a capacity to allow a patient to use the CPM device without having to remove their brace. By allowing a brace to be quickly connected and disconnected to the CPM device, the embodiments avoid requiring the user to remove the brace during therapy periods. This advantageously results in reduced downtime, comfort to the patient, and enhanced rehabilitation to the joint. By securing the brace to the CPM device, the embodiments can securely receive the limb to prevent the same from moving out of anatomical alignment during the operation thereof.

The embodiments of the present disclosure also offer a fast and effective way to receive CPM therapy. It is advantageous to provide a patient with an easy and convenient way of receiving CPM therapy. The CPM device of various embodiments offers a practical solution for a patient would otherwise need to transport a bulky and heavy CPM device and regularly remove their brace, and place the injured limb or joint on soft goods of the CPM device to ensure that the mechanics of the brace and the CPM device are not conflict and cause damage to the patient's limb or joint. By attaching the brace directly to the CPM device and eliminating the stationary base as in the embodiments, setup of the CPM device is easier and a faster and more comfortable therapy session can result.

In an embodiment, a CPM device includes a support structure arranged to be removably attached to an articulating brace supporting a limb and a joint of a user. One or more rotating members are rotatably connected to the support structure. The rotating members are adapted to contact and roll on an underlying surface that is separate from the CPM device. At least one motor is arranged to apply a torque to the rotating members such that the rotating members roll on the underlying surface. The rolling of the rotating members on the underlying surface causes the support structure to translate over the underlying surface, which, in turn, conveys a bending force to the joint.

Additional features and advantages of embodiments of the present disclosure will be set forth in the description that follows, and in part will be obvious from the description, or may be learned by the practice of such exemplary embodiments. These and other features will become more fully apparent from the following description and appended claims, or may be learned by the practice of such exemplary embodiments as set forth hereinafter.

BRIEF DESCRIPTION OF THE DRAWINGS

To further clarify the above and other advantages and features of the present disclosure, a more particular description of the disclosure will be rendered by reference to specific embodiments illustrated in the drawings. It is appreciated that these drawings depict only typical embodiments of the disclosure and are not to be considered limiting of scope, and are not necessarily drawn to scale. The disclosure will be described and explained with additional specificity and detail through the use of the accompanying drawings.

DETAILED DESCRIPTION

Figure 1:
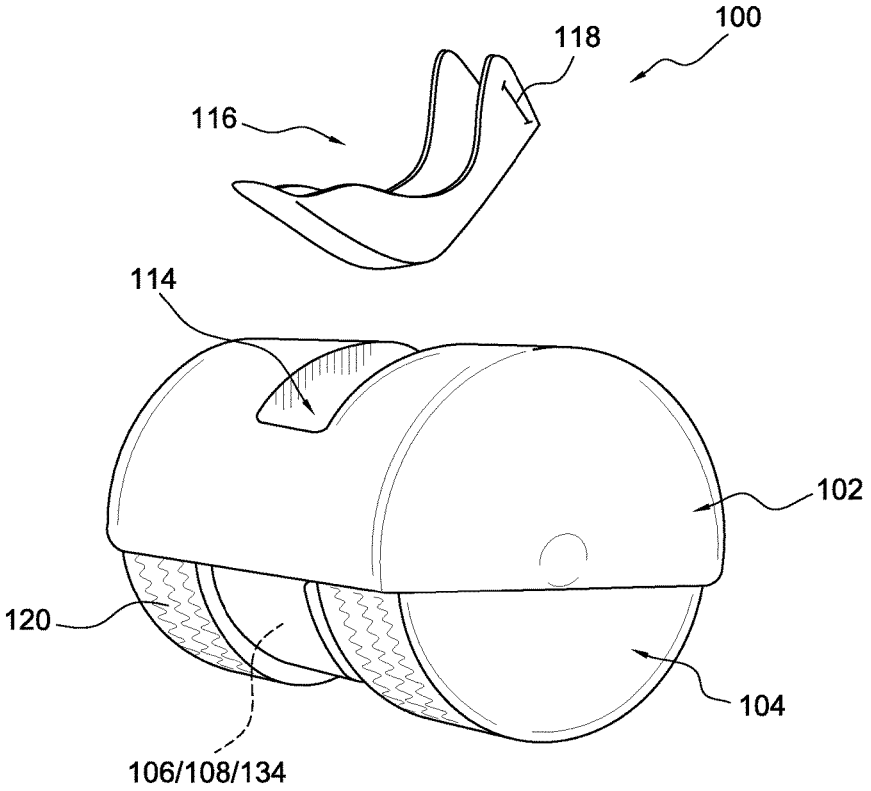
FIG. 1 is a partially exploded isometric view of a CPM device according to an embodiment.

A better understanding of different embodiments of the disclosure may be had from the following description read with the accompanying drawings in which like reference characters refer to like elements.

While the disclosure is susceptible to various modifications and alternative constructions, certain illustrative embodiments are in the drawings and are described below. It should be understood, however, there is no intention to limit the disclosure to the specific embodiments disclosed, but on the contrary, the intention covers all modifications, alternative constructions, combinations, and equivalents falling within the spirit and scope of the disclosure.

It will be understood that unless a term is expressly defined in this patent to possess a described meaning, there is no intent to limit the meaning of such term, either expressly or indirectly, beyond its plain or ordinary meaning.

The CPM device described is configured for use with a knee or leg. It should be remembered, however, that the same concepts and methods described may be similarly used for other CPM devices and are not limited solely to the anatomical locations discussed. For instance, the same concepts and methods describe may be used in CPM devices for imparting continuous passive motion to a shoulder, a hip, an elbow, an ankle, a finger, or other suitable joint.

Any element in a claim that does not explicitly state "means for" performing a specified function, or "step for" performing a specific function is not to be interpreted as a "means" or "step" clause as specified in 35 U.S.C. § 112, paragraph 6.

According to various embodiments of the disclosure, a CPM device is provided for imparting CPM therapy without the physical and operational restrictions of a stationary base, or the accompanying bulk and complicated features. Without a stationary base, the weight and size of the CPM device is significantly reduced and the CPM device can be easily transported and operated in a wide variety of settings. Thus, a user, a physician, and/or physical therapist can take the CPM device almost anywhere.

The embodiments also can address the problem of patients having to remove a post-surgical brace or other type of brace prior to CPM therapy. The embodiments have a capacity to allow a patient to use the CPM device without having to remove their brace. By allowing a brace to be quickly connected and disconnected to the CPM device, the embodiments avoid requiring the user to remove the brace during therapy periods. This advantageously results in reduced downtime, comfort to the patient, and enhanced rehabilitation to the joint. By securing the brace to the CPM device, the embodiments can securely receive the limb to prevent the same from moving out of anatomical alignment during the operation thereof.

The embodiments of the present disclosure also offer a fast and effective way to receive CPM therapy. It is advantageous to provide a patient with an easy and convenient way of receiving CPM therapy. The CPM device of various embodiments offers a practical solution for a patient who would otherwise need to transport a bulky and heavy CPM device and regularly remove their brace, and place the injured limb or joint on soft goods of the CPM device to ensure that the mechanics of the brace and the CPM device are not in conflict and do not cause damage to the patient's limb or joint. By attaching the brace directly to the CPM device and eliminating the stationary base as in the embodiments, setup of the CPM device is easier and a faster and more comfortable therapy session can result.

Figure 2:
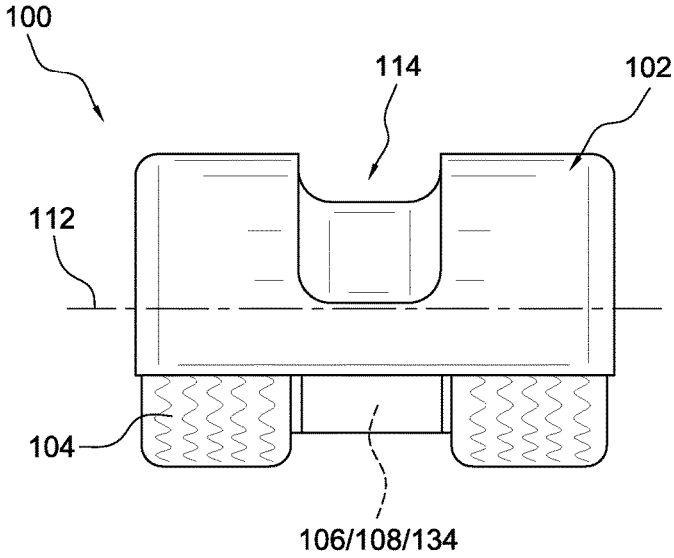
FIG. 2 is a front view of the CPM device shown in FIG. 1.
Figure 3:
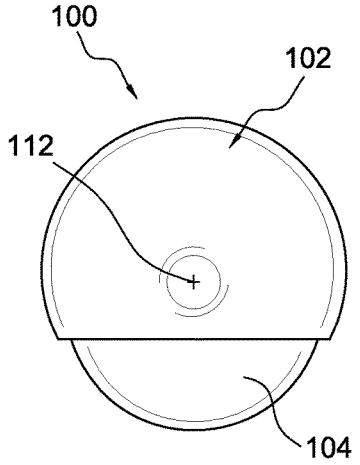
FIG. 3 is a side view of the CPM device shown in FIG. 1.

Turning now to the Figures, FIGS. 1-4 show a CPM device 100 according to an embodiment. In particular, FIGS. 1-3 show the CPM device 100 can include a support structure 102, one or more rotating members 104 rotatably connected to the support structure 102, a drive mechanism or motor 106, and a power source 108.

The support structure 102 is arranged to support a limb of a user (e.g., the limb shown in FIG. 3). The support structure 102 can define a pair of recesses, each having at least one rotating member 104 located therein. The support structure 102 can at least in part support and guide the rotating members 104. It can also protect the rotating members 104 from debris or foreign materials, and/or shield the rotating members 104 from coming into contact with the patient's body or clothes. The support structure 102 can be configured to rotate or not rotate about an axis 112. The support structure 102 can be formed of plastic materials, foam materials, rubber materials, metallic materials, combinations thereof, or any other suitable materials. It should be appreciated that many variations of the support structure having different shapes and sizes can be used for supporting the patient's leg. Although such variations may differ in form, they perform substantially similar functions The top of the support structure 102 can define a recessed portion forming a foot rest 114. The foot rest 114 can cradle at least a portion of a foot of a user (as shown in FIG. 3). A foot support member 116 can be removably positioned in the foot rest 114. The foot support member 116 is positionable in the foot rest 114 and is arranged to receive at least a portion of the foot and/or ankle of the user therein. The foot support member 116 can help secure the foot of the user to the support structure 102. For instance, the foot support member 116 can be pivotally or fixedly connected to the support structure 102. The foot support member 116 can be adjustably, releasably mounted within the foot rest 114 by any suitable means such as screws, bolts, pins, hook and loop fasteners, and the like.

Optionally, the foot support member 116 can define a variety of mounting locations therein. This allows the CPM device 100 to be used with different sized feet (e.g., an adult foot or a child foot). The foot support member 116 can also be interchangeable or adjustable such that the size and/or shape of the foot support member 116 can be adjustable. For instance, the CPM device 100 can include a small foot support member, a medium foot support member, and a large foot support member. This advantageously allows the CPM device 100 to be used with different sized feet and/or patients.

The foot support member 116 can include one or more connection features 118 for connecting and disconnecting an articulating brace mounted on a limb (e.g., the brace shown in FIG. 3) and the foot support member 116. This allows the user to utilize the CPM device 100 without removing a brace from the user's limb, substantially reducing downtime and enhancing comfort to the user and rehabilitation of the user's joint.

The brace can be pivotally or fixedly connected to the foot support member 116. The brace can include an upper leg support 128, a lower leg support 130, and a hinge assembly 126 pivotally connecting the upper leg support 128 and the lower leg support 130. A lower end portion 130A of the lower leg support 130 can be removably attached to the foot support member 116 via the connection features 118.

The brace can define a pivot axis extending through the hinge assembly of the brace, which, in turn, can define or coincide with the pivot axis of the user's limb or joint when the user is wearing the brace. Because the brace defines the pivot axis of the user's limb and/or joint, the pivot axis of the user's limb and/or joint can be the same or substantially the same when the brace is secured to the CPM device 100 and when the brace is not secured to the CPM device 100. Such consistency of the pivot axis of the user's limb and/or joint can avoid damage to the user's limb and/or joint that can result from anatomical misalignment or the pivot axis of the user's limb and/or joint being shifted or moved when the user's limb is removed from a post-operative brace and secured to a conventional limb support of a CPM device, as in the prior art.

Moreover, because the brace defines the pivot axis of the user's limb and/or joint when secured to the CPM device 100 rather than a fixed limb support on a CPM device, the CPM device 100 can also anatomically receive either a right limb or a left limb without need to adjust the CPM device 100.

The connection between the foot support member 116 and the brace can help align the pivot axis of the knee with the pivot of the hip and/or CPM device 100 rather than having to repeatedly reposition the limb in the CPM device to achieve anatomical alignment, as in the prior art. This can reduce the number of steps required to set-up the CPM device 100, which in turn, substantially simplifies its use and makes it more adapted for use in a home or other non-professional setting.

The connection features 118 can comprise any suitable means for securing the brace to the foot support member 116. The connection features 118 can comprise through-slots formed in the foot support member 116 adapted to receive arms of the lower leg support of the brace and/or apertures in the foot support member 116, which are configured to selectively capture and retain spring biased buttons carried on the arms.

The connection features 118 can comprise quick-connect devices 138 adapted for a relatively rapid and easy connection between elements. The connection features 118 can comprise snaps, screws, bolts, pins, hook and loop fasteners, combination thereof, or any other suitable connection feature. Alternatively, the foot support member 116 can be omitted and the brace can be connected to and disconnected from the support structure 102.

It is understood that the present disclosure is not limited to using any particular type of brace with the CPM device 100. All that is necessary to achieve the function of the present disclosure is to provide the appropriate connections between the brace and the foot support member 116 and/or the support structure 102. The brace can be individually adapted to connect to the CPM device 100. The brace can include any suitable conventional brace. For example, the brace can comprise the Innovator DLX+, a post-operative brace commercially available from Ossur, in Reykjavik, Iceland. Other examples of a brace are found in U.S. Pat. No. 7,037,287, granted May 2, 2006, and U.S. Pat. No. 8,172,781, granted May 8, 2012, and U.S. Pat. No. 8,517,964, granted Aug. 27, 2013, each of which are incorporated herein by reference in their entirety. Of course, other braces may be employed.

Referring now to FIGS. 2 and 3, the rotating members can be wheels 104 rotatably attached to the support structure 102 and arranged to rotate about the axis 112 (shown in FIG. 2). During operation of the CPM device 100, the wheels 104 contact and roll on an underlying surface 122 (shown in FIG. 4) that is separate from the CPM device 100. The underlying surface 122 can comprise a floor, a bed, a couch, a pad, a wood floor, a table, carpet, tile, grass, a countertop, or any other suitable underlying surface. The capability of the CPM device 100 to operate on underlying surfaces that are separate and independent of the CPM device 100 allows the CPM device 100 to be operated in more and a wider variety of settings than the prior art, substantially increasing the versatility of the CPM device 100.

The wheels 104 may be made of any material suitable to allow the CPM device 100 to drive over the underlying surface. For instance, the wheels 104 can be made of rubber, plastic foam, rigid plastic, lightweight metal, a silicone, combinations thereof, or any other suitable material. Optionally, the wheels 104 can include a tread surface 120 for improving traction between the wheels 104 and the underlying surface 122.

As seen, the CPM device 100 does not includes a stationary base supporting the components of the CPM device 100, as in the prior art. This allows the size and weight of the CPM device 100 to be substantially reduced. This also results in the CPM device 100 being more transportable and available for use in a home setting. The CPM device 100 also eliminates the operational and physical restrictions of a stationary base. For instance, the range of motion of the CPM device 100 can be limited by the brace and/or the user's limb, not the physical size or confines of a stationary base.

The motor 106 (shown in FIGS. 1 and 2) can be housed in the support structure 102 and arranged to apply torque to at least one of the wheels 104. When the motor 106 applies torque to the wheels 104, the wheels 104 roll on the underlying surface 122, which, in turn, causes the support structure 102 to translate over the underlying surface 122. As the support structure 102 translates over the underlying surface 122, the brace 124, which is attached to the foot support member 116, can pivot at the hinge assembly 126 of the brace 124. In this way, a bending force can be conveyed to the knee, to thereby provide a rehabilitating force to the knee joint. The pivoting of the brace 124 in conjunction with the translation supplied by the support structure 102 can allow for knee joint flexion and extension while maintaining a rotational axis along the hip joint that remains stationary while the hip joint rotates. By maintaining a stationary rotational axis along the hip joint, the user's torso may remain relatively stationary during the CPM therapy, increasing comfort and effectiveness.

Figure 4:
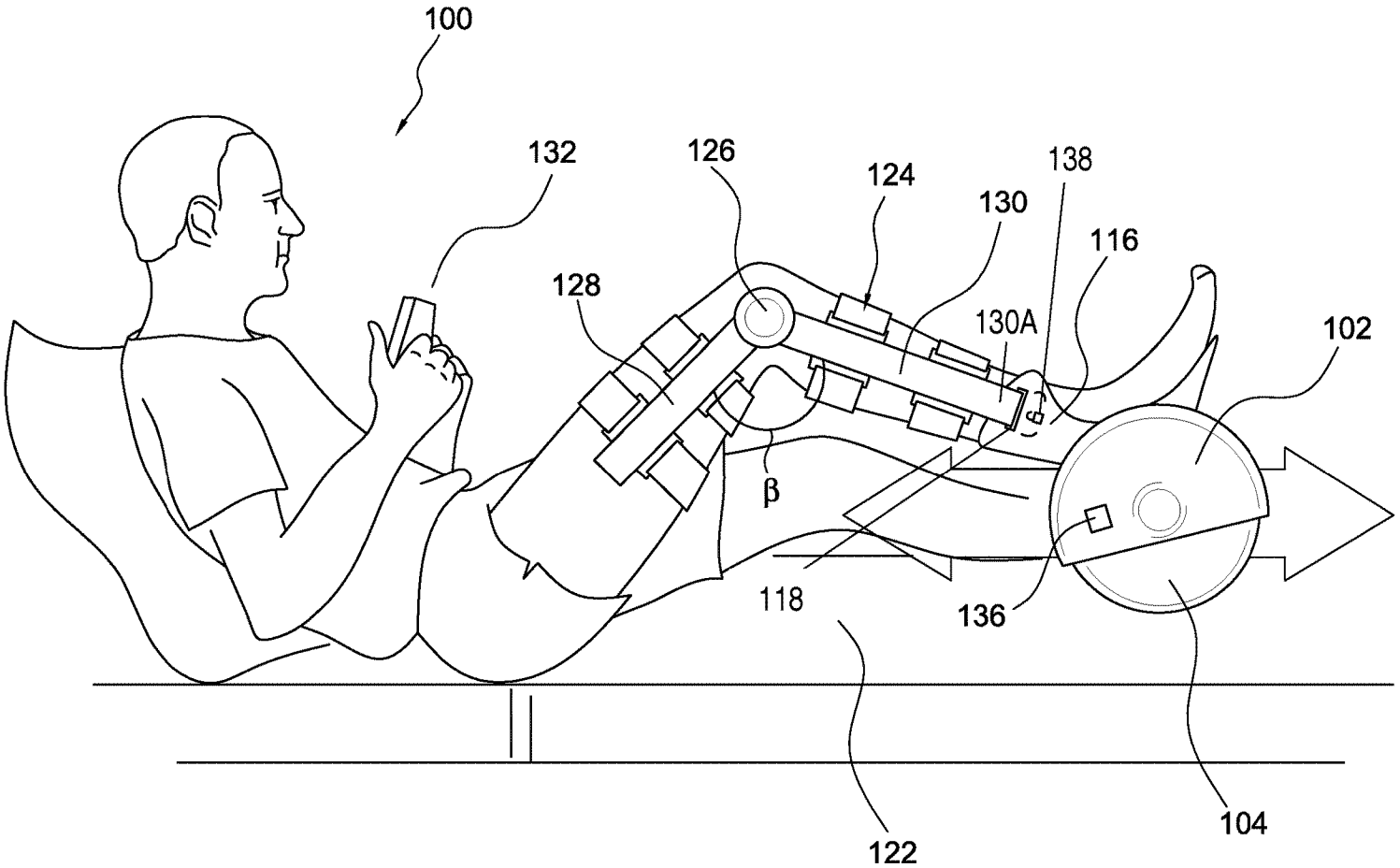
FIG. 4 is a schematic view of the CPM device shown in FIG. 1 in use according to an embodiment.

Referring briefly to FIG. 4, rotation of the wheels 104 in a first rotational direction by the motor 106 can cause the support structure 102 to move away from the user. This causes the angle between upper leg support 128 and the lower leg support 130 of the brace 124 to increase, which, in turn, results in knee extension. The support structure 102 can move at controlled rate (steady or variable) away from the user until the CPM device 100 and/or the brace 124 reaches an extension limit. The extension limit can be defined by operating parameters of the motor and/or the angle β between the upper and lower leg supports of the brace 124 to which the upper leg support 128 and/or the lower leg support 130 are pivoted during an extension phase.

Rotation of the wheels 104 in a second rotational direction (opposite the first rotational direction) by the motor 106 causes the support structure 102 to move toward the user. This causes the angle β between the upper leg support 128 and the lower leg support 130 to decrease, which, in turn, causes knee flexion. The support structure 102 can move at a controlled rate (steady or variable) toward the user until the CPM device 100 and/or the brace 124 reaches a flexion limit. Like the extension limit, the flexion limit can be defined by operating parameters of the motor and/or a flexion angle between the lower and upper leg supports of the brace 124 to which the lower and upper leg supports are pivoted during flexion phase. The flexion limit and/or the extension limit can be adjustable and/or customizable based on the individual needs of the user.

Referring again to FIGS. 1 and 2, the motor 106 can be any suitable motor arranged for producing rotational motion or machine configured to produce motion or power for doing work. The motor 106 can comprise magnets, a magnetic motor, an alternating current electric motor, a direct current motor, a stepper motor, an internal combustion motor, a hydraulic motor, or any other suitable type of motor. The motor 106 can be a fixed speed or a variable-speed motor. For instance, a variable speed motor can help limit jerking of the user's leg at flexion and/or extension limits. The motor 106 can comprise an AC induction motor controlled by a variable speed drive.

The motor 106 may be operable in two opposing rotational directions, thereby providing CPM in at least two directions. The motor 106 may include a timer providing CPM for a desired amount of time, or may be programmed for intermittent operation. The power source 108 can comprise a battery pack configured to supply power to the motor 106. The battery pack can be inserted in the support structure 102 or located external to the CPM device 100. Alternatively, the motor 106 can be powered by an AC power supply, fuel cells, solar generator, wind generator, rechargeable batteries, commercially available electricity of voltages, combinations thereof, or any other suitable power source.

A control system 134 can be associated with the CPM device 100. The control system 134 can be operable to control operation of one or more of the foregoing components (e.g., motor 106 and/or wheels 104). The control system 134 can be internal to or external to the CPM device 100. The control system 134 may be operable or programmable for controlling operational parameters, including but not limited to: motor on, motor off, and time intervals of same; wheel speed, motor speed, and direction of motor. For instance, the control system 134 can be operated or programmed to result in different movement patterns of the CPM device 100 and/or wheel speeds.

The control system 134 can be integrated with the motor 106 and/or support structure 102. The control system 134 can be separated from the motor 106 and/or support structure 102. The control system 134 can comprise or can be integrated with a remote controller described below. The control system 134 may comprise a computer. The computer can be a personal computer, a desktop computer, a laptop computer, a message processor, a hand-held device, a multiprocessor system, a microprocessor-based or programmable consumer electronics device, a network PC, a minicomputer, a mainframe computer, a smart phone, a PDA, a tablet, combinations thereof, or the like. The control system 134 can be a universal controller.

The control system 134 can include an I/O module. The I/O module can communicate with the CPM device 100, a user, other modules of the control system 134, components of the CPM device 100, and/or other computer systems. A processing module of the control system 134 can execute computer executable instructions and/or process operational data. The processing module may be operably coupled to a memory. The memory can store an application including computer executable instructions, measurement data, operational data, and/or a program to perform certain acts. For instance, the processing module may be operably coupled to the memory storing an application including computer executable instructions and data constituting a customized program to perform different movement patterns with the CPM device.

The CPM device 100 can include one or more sensors 136 (shown in FIG. 4) in communication with the control system 134 via the I/O module. The one or more sensors 136 can be attached to and/or integrated with the support structure 102, the motor 106, the rotating members 108, the foot support member 116, the wheels 104, and/or the brace 124.

The one or more sensors 136 can be adapted for determining the velocity of the CPM device 100, defining and/or monitoring a range of motion for the CPM device 100, and/or for providing biofeedback to a user. For instance, the CPM device 100 can include sensors 136 capable of receiving and transmitting information pertaining to position of one or more components of the CPM device 100 and/or the user's leg, motion, the angle of flexion, a selected allowable range of flexion, and/or other information to the control system 134. Such a sensor 136 may receive and/or transmit information mechanically or electrically.

Based on the information received from the sensors 136, the control system 134 can direct operation of the motor 106. For instance, the sensor 136 can transmit flexion information to the control system 134 where it is processed by the processing module and used to control the motor 106 such that linear movement of the support structure 102 does not exceed a selected range of flexion of the brace 124.

In some embodiments, the user can communicate with the control system 134 via a wired or wireless remote controller 132. The remote controller 132 can communicate with the control system 134 through the internet (wireless or wired), the cloud, a smartphone, tablet computing device, an application on a smartphone or tablet, or any suitable means. The remote controller 132 can transmit user input to the control system 134. For instance, the remote controller 132 can include an on-off switch and a motion reversing button. The remote controller 132 can receive information from the control system 134. For instance, the remote controller 132 can receive data and/or reporting information from the control system 134 (e.g., number of cycles performed per day versus a target number of cycles).

Optionally, the CPM device 100 can include one or more features such that certain parameters of the operation and controls of the CPM device 100 can be exclusively adjusted or controlled by a physical therapist or physician. For instance, the control system 134 can be securely connected to a private, public, or world-wide network such that it can record, receive and/or send operational parameters or a summary of a therapy session to a designated remote controller computer, providing a physician or physical therapist access to in-home treatment data.

It will be appreciated that the CPM device 100 is to be regarded as exemplary only, as any CPM device is possible. For example, while the CPM device 100 is described including a single motor, in other embodiments, the CPM device 100 can include two, three, or any other suitable number of motors. In other embodiments, the rotating members 104 can be operated by independent motors. In other embodiments, the rotating members can include one or more continuous tracks positioned on two or more wheels. The tracks can be in contact with a larger surface area than would generally be the case with wheels alone. This can exert a larger force per unit area on the underlying surface. This makes the use of tracks particularly suitable for use on a soft, low friction, and uneven underlying surface, such as a bed or couch.

Alternatively, the CPM device can be used without a brace. For instance, a user can position their foot in the foot rest or the foot support member without wearing a brace such that the support structure supports the user's leg. In this arrangement, translation of the support structure over the underlying surface can convey a bending force to the knee joint. This advantageously allows the CPM device to provide joint motion therapy for healing (e.g., arthritis relief or cartilage repair) where medial and/or lateral stability is not critical.

Figure 5:
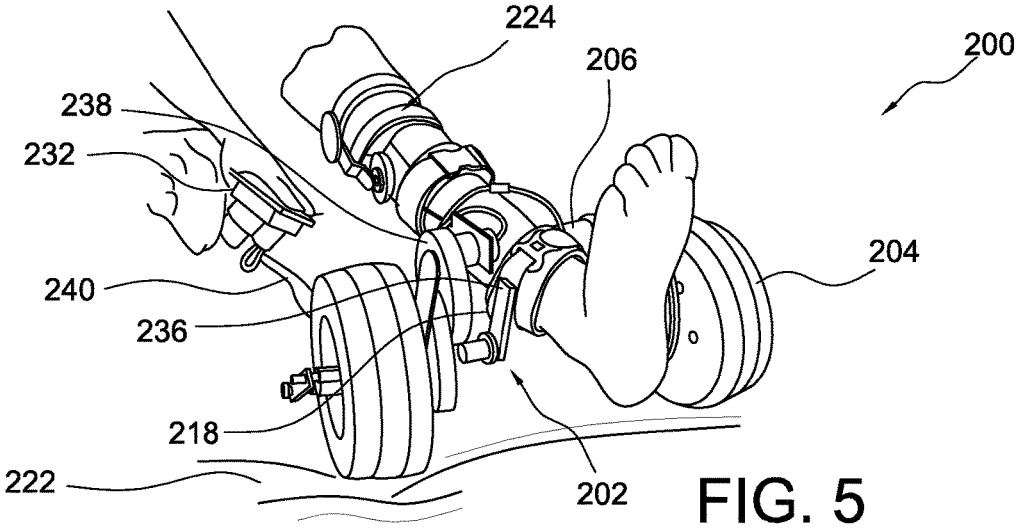
FIG. 5 is an isometric view of a CPM device according to another embodiment.
Figure 6:
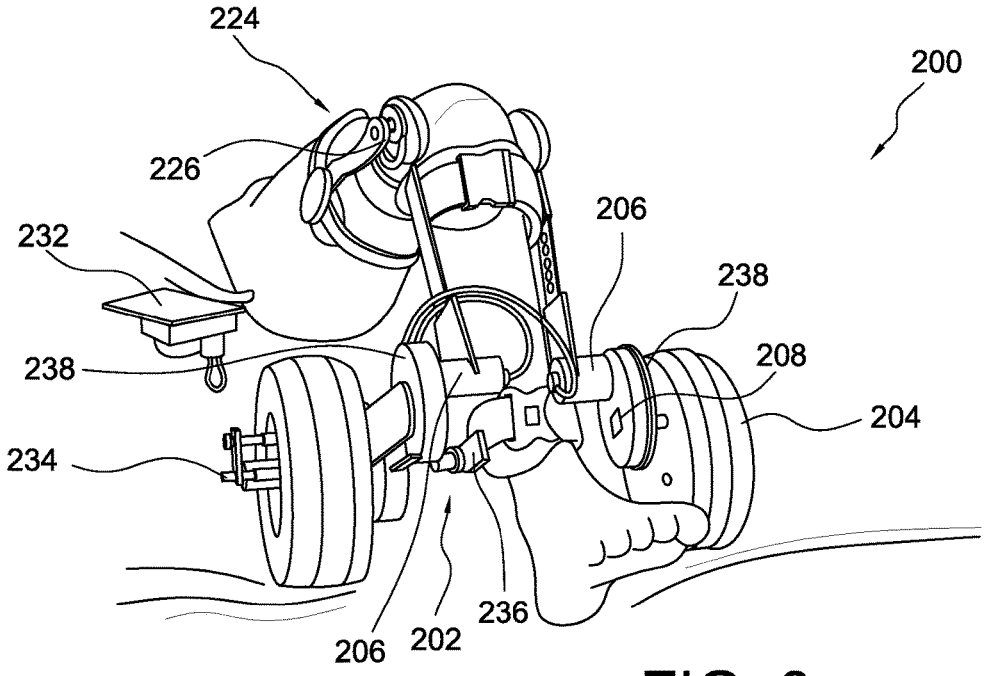
FIG. 6 is another isometric view of the CPM device shown in FIG. 5.

FIGS. 5 and 6 illustrate another example embodiment of a CPM device 200 within the scope of the disclosure. The CPM device 200 can have many of the same components and features that are included in the CPM device 100. Therefore, in the interest of brevity, the components and features of the CPM devices 100 and 200 that correspond to one another have been provided with the same or similar reference numbers, and an explanation thereof will not be repeated. However, it should be noted that the principles of the CPM device 200 may be employed with any of the embodiments described in relation to FIG. 1-3, and vice versa.

As seen in FIG. 4, the CPM device 200 can include a support structure 202, one or more rotating members comprising two wheels 204, a motor 206, and a power source 208. Similar to the support structure 102, the support structure 202 can be configured to support a user's limb and can exhibit any suitable configuration. The support structure 202 can comprise a shaft 234 generally extending between the wheels 204 and a pair of support brackets 236. The support structure 202 can be formed of plastic materials, metallic materials, combinations thereof, or any other suitable material.

The support brackets 236 can exhibit any suitable configuration and can include one or more connection features 220 for connecting and disconnecting an articulating brace 224 from the CPM device 200. As seen, the brace 224 can be connected directly to the support structure 202. The support brackets 236 can be sized and configured to provide a clearance or space between the support structure 202 and the user's limb during use.

The connection features 218 can comprise mechanical fasteners, pins, bolts, fastener holes, combinations thereof, or any other suitable connection feature. This allows the user to utilize the CPM device 200 without removing a brace from the user's limb, substantially reducing downtime and enhancing comfort to the user and rehabilitation of the user's joint. The brace 224 can be pivotally or non-pivotally connected to the support brackets 236.

The wheels 204 can be supported by the support structure 202. The wheels 204 can be rotatably attached to the support structure 202 and configured to rotate about an axis extending through the shaft 234. The wheels 204 can be configured to contact and roll on an underlying surface 222 that is separate from the CPM device 100. This advantageously allows the CPM device 200 to operate in a wide variety and settings, substantially improving the versatility of the CPM device 200 over the prior art. As seen, like the CPM device 100, the CPM device 200 also does not include a stationary base. This results in making the CPM device 200 more transportable and available for use in a home setting. This also eliminates the operational and physical restrictions of a stationary base.

As shown, the motor 206 can comprise a pair of motors 206 secured to the support structure 202. Each motor 206 can be configured to apply a torque to a respective one of the wheels 204 via a respective device mechanism 238. The motors 206 can comprise any suitable type of motor. The drive mechanisms 238 can comprise any suitable type of drive mechanisms. The power source 208 can comprise a battery back or other suitable power source configured to supply power to the motors 206. The battery pack can be connected to the support structure 202 and/or separate from the support structure 202. Similar to the CPM device 100, the CPM device 200 can include a control system to control operating parameters of the CPM device 200. In some embodiments, the motors 206 and the operation of the CPM device 200 can be controlled by a patient or operator using a wired remote controller 232. A control cord 240 may communicatively connect the remote controller 232 with the control module and/or circuitry of the motors 106.

When the motors 206 apply torque to the wheels 204, the wheels 204 roll on the underlying surface 222, which, in turn, causes the support structure 202 carrying the brace 224 and the user's limb to translate over the underlying surface. As the support structure 202 translates over the underlying surface, the brace 224 can pivot at the hinge assembly 226 of the brace 224. In this way, a bending force can be conveyed to the knee, to thereby provide a rehabilitating force to the knee joint. The pivoting of the brace 224 in conjunction with the translational movement supplied by the support structure 202 can allow for knee joint flexion and extension. FIG. 5 illustrates the CPM device 200 causing passive extension of the limb of a user. FIG. 6 illustrates the CPM device 200 causing passive flexion of the limb of the user. It will be appreciated that the CPM device 200 can be configured to move the limb at a controlled rate over a controlled distance between an extension limit and a flexion limit as described above.

Alternatively, the drive mechanism/motor can be operatively connected to the brace rather than the support structure and/or wheels. For instance, the motor can be operatively attached to the brace and configured apply a torque to the brace, which, in turn, can pivot the hinge assembly of the brace. The wheels can be operatively connected to the brace via the support structure and/or other components. When the hinge assembly pivots, the wheels can roll on the underlying surface, which, in turn, allows the support structure to translate over the underlying surface. In this way, a bending force can be conveyed to the knee, to thereby provide a rehabilitating force to the knee joint.

While various aspects and embodiments have been disclosed herein, other aspects and embodiments are contemplated. The various aspects and embodiments disclosed herein are for purposes of illustration and are not intended to be limiting. Additionally, the words "including," "having," and variants thereof (e.g., "includes" and "has") as used herein, including the claims, shall be open-ended and have the same meaning as the word "comprising" and variants thereof (e.g., "comprise" and "comprises").

What is claimed is:

1. A continuous passive motion ("CPM") device comprising:

a support structure adapted to support a leg and a knee joint of a user;

one or more rotating members rotatably connected to the support structure, the one or more rotating members being adapted for contacting and rolling on an underlying surface separate from the CPM device;

at least one motor housed in the support structure and configured to apply a torque to the one or more rotating members such that the one or more rotating members roll on the underlying surface, wherein the rolling of the one or more rotating members on the underlying surface causes the support structure to translate over the underlying surface and conveys a bending force to the knee joint; and an articulating knee brace adapted to receive and support the knee joint and removably attachable to the support structure, the articulating knee brace defining a same pivot axis through the knee joint when the support structure conveys the bending force to the knee joint and when the articulating knee brace is removed from the support structure and worn by the user, wherein the at least one motor applies the torque to the one or more rotating members independent of a pivoting movement of the articulating brace such that the support structure conveys the bending force to the knee joint with and without the articulating knee brace attached to the support structure.

2. The CPM device of claim 1, wherein the rolling of the one or more rotating members in a first direction causes the support structure to move away from the user until the articulating knee brace reaches an extension limit.

3. A continuous passive motion ("CPM") device comprising:

a support structure configured to support a leg and a knee joint of a user, a top of the support structure defining a recessed portion configured to cradle at least a portion of a foot of the user;

one or more rotating members rotatably connected to the support structure, the one or more rotating members being adapted for contacting and rolling on an underlying surface separate from the CPM device;

at least one motor housed in the support structure and configured to apply a torque to the one or more rotating members such that the one or more rotating members roll on the underlying surface, wherein the rolling of the one or more rotating members on the underlying surface causes the support structure to translate over the underlying surface and conveys a bending force to the knee joint;

an articulating knee brace adapted to receive and support the knee joint and removably attachable to the support structure, the articulating knee brace defining a same pivot axis through the knee joint when the support structure conveys the bending force to the knee joint and when the articulating knee brace is removed from the support structure and worn by the user, wherein the at least one motor applies the torque to the one or more rotating members independent of a pivoting movement of the articulating knee brace such that the support structure conveys the bending force to the knee joint with and without the articulating knee brace attached to the support structure; and a foot support member removably positionable in the recessed portion of the support structure for connecting the articulating knee brace to the support structure, the foot support member configured to receive and wrap around at least a posterior aspect of the foot.

4. The CPM device of claim 3, wherein the foot support member is interchangeable with other foot support members.

5. The CPM device of claim 3, wherein the articulating knee brace includes an upper leg support, a lower leg support, and a hinge assembly pivotally connecting the upper and lower leg supports, the lower leg support being operatively attached to the support structure.

6. The CPM device of claim 5, wherein the rolling of the one or more rotating members on the underlying surface varies an angle defined between the upper leg support and the lower leg support.

7. The CPM device of claim 5, wherein the rolling of the one or more rotating members in a first direction causes the support structure to move away from the user until the articulating knee brace reaches an extension limit.

8. The CPM device of claim 7, wherein the extension limit is defined by one or more operating parameters of the at least one motor.

9. The CPM device of claim 7, wherein the extension limit is defined by the articulating knee brace.

10. The CPM device of claim 7, wherein the rolling of the one or more rotating members in a second direction opposite the first direction causes the support structure to move toward the user until the articulating knee brace reaches a flexion limit.

11. The CPM device of claim 3, wherein the foot support member is connectable to a lower end portion of the articulating knee brace, wherein the foot support member is pivotally connected to the support structure.

12. The CPM device of claim 11, wherein the foot support member is configured to wrap around lateral and medial aspects of the foot.

13. The CPM device of claim 11, wherein the foot support member defines a pair of slots configured to receive the lower end portion of the articulating knee brace.

14. The CPM device of claim 3, wherein the underlying surface comprises a bed, a couch, a mat, a floor surface or a ground surface.

15. The CPM device of claim 3, further comprising a control system operatively connected to the at least one motor, and one or more sensors in communication with the control system.

16. The CPM device of claim 15, further comprising a remote controller in communication with the control system, and configured to transmit user input to the control system.

17. The CPM device of claim 16, wherein the one or more sensors provide position information associated with the knee of the user to the control system.

18. A continuous passive motion ("CPM") system comprising:

an articulating knee brace including an upper leg support, a lower leg support, and a hinge assembly pivotally connecting the upper leg support and the lower leg support, the articulating brace adapted to receive and support a leg and a knee joint of a user; and a CPM device removably attachable to a lower end portion of the lower leg support, the CPM device comprising:

a support structure;

one or more rotating members rotatably connected to the support structure, the one or more rotating members adapted for contacting and rolling on an underlying surface separate from the CPM device;

at least one motor housed in the support structure and configured to apply a torque to the one or more rotating members such that the one or more rotating members roll on the underlying surface, wherein the rolling of the one or more rotating members on the underlying surface causes the support structure to translate over the underlying surface and conveys a bending force to the knee joint, wherein the articulating knee brace defines a same pivot axis through the knee joint when the support structure conveys the bending force to the knee joint and when the articulating knee brace is removed from the support structure and worn by the user, wherein the at least one motor applies the torque to the one or more rotating members independent of a pivoting movement of the articulating knee brace such that the support structure conveys the bending force to the knee joint with and without the articulating knee brace attached to the support structure.

* * * * *